US008749111B2

(12) United States Patent
Lee

(10) Patent No.: US 8,749,111 B2
(45) Date of Patent: Jun. 10, 2014

(54) MOTOR FOR WASHING MACHINE AND WASHING MACHINE HAVING THE SAME

(75) Inventor: Woon Yong Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 345 days.

(21) Appl. No.: 13/067,950

(22) Filed: Jul. 8, 2011

(65) Prior Publication Data

US 2012/0043833 A1 Feb. 23, 2012

(30) Foreign Application Priority Data

Aug. 20, 2010 (KR) ..... 10-2010-0080788

(51) Int. Cl.
*H02K 1/22* (2006.01)

(52) U.S. Cl.
USPC ..... 310/261.1; 310/156.26

(58) Field of Classification Search
USPC ..... 310/43, 156.21, 156.31, 156.26, 261.1; 68/24, 140
See application file for complete search history.

(56) References Cited

U.S. PATENT DOCUMENTS

| | | | | |
|---|---|---|---|---|
| 6,049,930 | A * | 4/2000 | Hisano et al. | 8/159 |
| 7,397,158 | B2 * | 7/2008 | Lee et al. | 310/156.26 |
| 2010/0050702 | A1 * | 3/2010 | Kim et al. | 68/23 R |
| 2010/0058817 | A1 | 3/2010 | Yoshikawa et al. | |
| 2010/0133932 | A1 * | 6/2010 | Zhang | 310/59 |

FOREIGN PATENT DOCUMENTS

| | | |
|---|---|---|
| EP | 1548171 A2 | 6/2005 |
| JP | 60-174038 | 9/1985 |

OTHER PUBLICATIONS

European Search Report dated Nov. 17, 2011 issued in corresponding European Patent Application No. 11174771.3.

* cited by examiner

*Primary Examiner* — Hanh Nguyen
(74) *Attorney, Agent, or Firm* — Staas & Halsey LLP

(57) ABSTRACT

A motor include a rotor to rotate a drum of the washing machine, and the rotor includes a base, a ring-shaped rib formed at the edge of the base, and a back yoke ring connected to the ring-shaped rib. The back yoke ring is inserted into the ring-shaped rib while the base is formed by injection molding.

10 Claims, 8 Drawing Sheets

MOTOR FOR WASHING MACHINE AND WASHING MACHINE HAVING THE SAME

CROSS-REFERENCE TO RELATED APPLICATIONS

This application claims the benefit of Korean Patent Application No. 2010-0080788, filed on Aug. 20, 2010 in the Korean Intellectual Property Office, the disclosure of which is incorporated herein by reference.

BACKGROUND

1. Field

Embodiments relate to a motor which drives a drum of a washing machine.

2. Description of the Related Art

A washing machine is an apparatus which washes laundry using electricity, and generally includes a tub to contain wash water, a drum rotatably installed in the tub, and a motor to rotate the drum.

When the drum is rotated by the motor under the condition that laundry and detergent-containing water are supplied into the drum, dirt is removed from the laundry using friction of the laundry with the drum and the wash water.

Washing machines are divided into an indirect driving type in which power of a motor is transmitted to a drum through a power transmission device including belts and pulleys and a direct driving type in which power of a motor is transmitted directly to a shaft of a drum.

A motor of a direct driving type washing machine includes a stator mounted on a tub, and a rotor disposed around the stator and electromagnetically interacting with the stator.

SUMMARY

Therefore, it is an aspect to provide a motor for a washing machine which is improved so as to shorten a manufacturing process thereof, and a washing machine having the same.

It is another aspect to provide a motor for a washing machine which is improved so as to reduce noise generation, and a washing machine having the same.

Additional aspects will be set forth in part in the description which follows and, in part, will be apparent from the description, or may be learned by practice of the invention.

In accordance with one aspect, in a motor for a washing machine including a rotor to rotate a drum of the washing machine, the rotor includes a base, a ring-shaped rib formed at the edge of the base, and a back yoke ring connected to the ring-shaped rib, wherein the back yoke ring is inserted into the ring-shaped rib while the base is formed by injection molding.

The ring-shaped rib and the back yoke ring may be made of different materials and the back yoke ring may be connected to the upper portion of the ring-shaped rib in a direction of extending the ring-shaped rib.

A connection groove connected with one end of the back yoke ring may be provided on the upper portion of the ring-shaped rib.

At least one connection protrusion formed in the circumferential direction of the base may be provided at the inside of the connection groove, and at least one connection hole connected with the at least one connection protrusion may be provided on the side surface of the back yoke ring in the circumferential direction of the back yoke ring.

Magnets may be connected to the inner surface of the back yoke ring in the circumferential direction of the back yoke ring.

The base may include air inflow holes formed through the base in the radial direction.

The base may include cooling blades protruded to the inside of the rotor.

In accordance with another aspect, in a motor for a washing machine including a rotor connected with a drive shaft, the rotor includes a bottom formed by injection molding using plastic, a ring-shaped rib formed at the edge of the bottom, a side wall made of metal having magnetic properties and connected to the ring-shaped rib, and magnets connected to the inner surface of the side wall in the circumferential direction of the side wall, wherein the side wall is inserted into the ring-shaped rib while the bottom is formed by injection molding.

The side wall may be connected to the upper portion of the ring-shaped rib in a direction of extending the ring-shaped rib.

A connection groove connected with one end of the side wall may be provided on the upper portion of the ring-shaped rib, and at least one connection protrusion formed in the circumferential direction of the bottom may be provided at the inside of the connection groove The side wall may include a bending part bent in a direction of extending the radius of the side wall and at least one through hole formed so as to allow molten resin to pass through the side surface of the side wall during the injection molding process of the bottom.

The bottom may include air inflow holes formed through the bottom in the radial direction so that external air is introduced into the rotor through the air inflow holes and cooling blades protruded to the inside of the rotor so as to generate an air flow within the rotor.

A central part of the bottom may be protruded to the inside of the rotor.

In accordance with another aspect, in a motor for a washing machine including a stator and a rotor, the rotor includes a base, a first side wall protruded from the edge of the base, and a second side wall connected with the first side wall, wherein the first side wall and the second side wall are made of different materials and the second side wall is connected to the upper portion of the first side wall in parallel with the first side wall.

In accordance with another aspect, a manufacturing method of a rotor for a washing machine, which has a bottom and a side wall connected with the bottom, includes manufacturing the side wall by cutting a cylindrical pipe, fixing the side wall to a mold, and injecting molten synthetic resin into the mold, wherein the side wall is inserted into the bottom while the bottom is formed by injection molding.

In accordance with a further aspect, a manufacturing method of a rotor for a washing machine, which has a bottom and a side wall connected with the bottom, includes manufacturing the side wall by rolling a sheet having a thickness of 1 mm or more into a cylindrical shape and fixing both ends of the sheet, fixing the side wall to a mold, and injecting molten synthetic resin into the mold, wherein the side wall is inserted into the bottom while the bottom is formed by injection molding.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
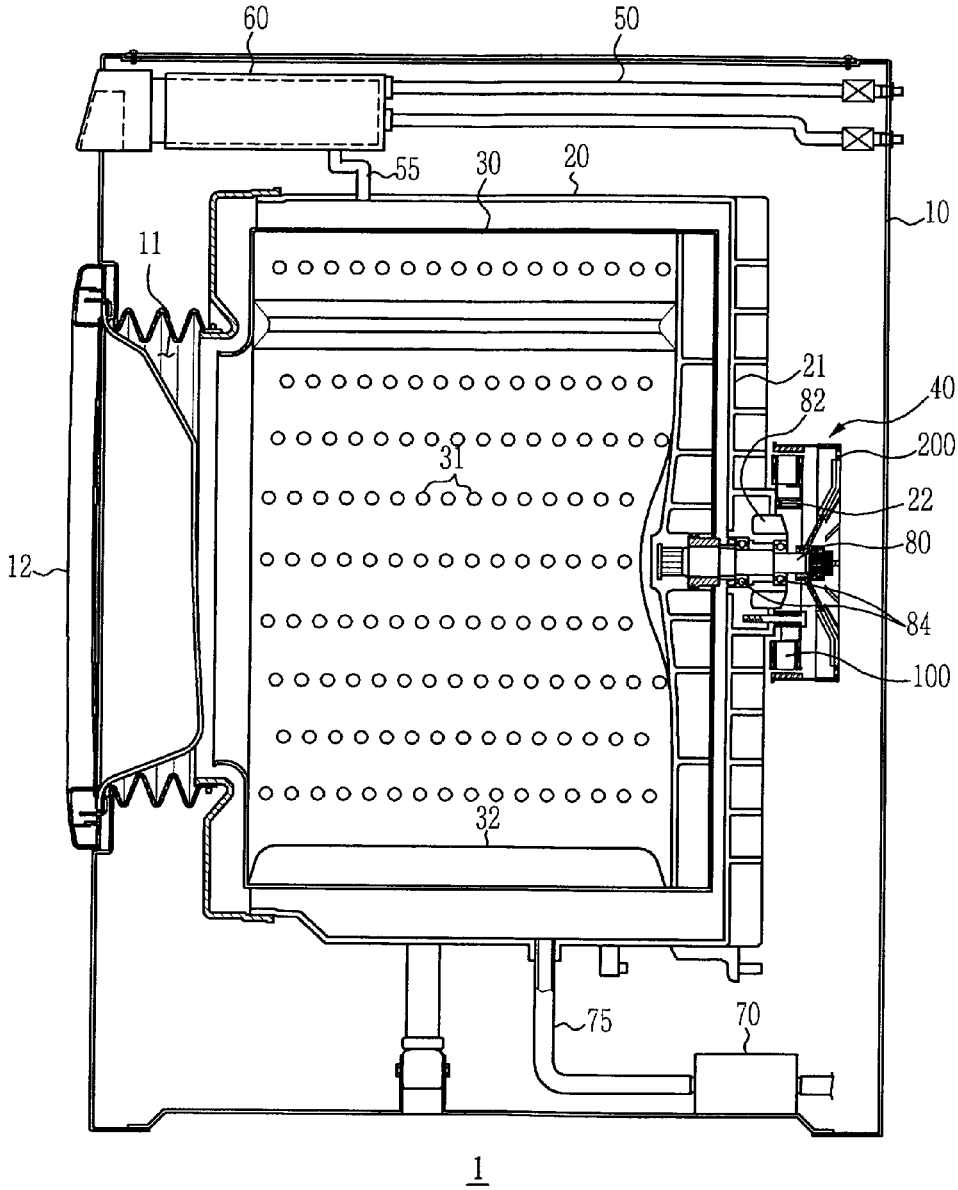
FIG. 1 is a view illustrating a washing machine in accordance with one embodiment.

Reference will now be made in detail to the embodiments, examples of which are illustrated in the accompanying drawings, wherein like reference numerals refer to like elements throughout.

FIG. 1 is a view illustrating a washing machine in accordance with one embodiment.

As shown in FIG. 1, a washing machine 1 in accordance with this embodiment includes a cabinet 10 forming the external appearance of the washing machine 1, a tub 20 disposed in the cabinet 10, a drum 30 rotatably disposed in the tub 20, and a motor 40 to drive the drum 30.

An inlet 11 is formed through the front surface of the cabinet 10 so that the laundry is put into the drum 30 through the inlet 11. The inlet 11 is opened and closed by a door 12 installed on the front surface of the cabinet 10.

Water supply pipes 50 to supply wash water to the tub 20 are installed above the tub 20. Ends of the water supply pipes 50 are connected to an external water supply source (not shown), and the other ends of the water supply pipes 50 are connected to a detergent supply device 60. The detergent supply device 60 is connected to the tub 20 through a connection pipe 55. Water supplied through the water supply pipes 50 passes through the detergent supply device 60, and then a water-detergent mixture is supplied to the inside of the tub 20.

A drain pump 70 and a drain pipe 75 to discharge water in the tub 20 to the outside of the cabinet 10 are installed under the tub 20.

A plurality of through holes 31 to circulate wash water is formed through the circumferential surface of the tub 20, and a plurality of lifters 32 to tumble laundry when the drum 30 is rotated is installed on the inner circumferential surface of the drum 30.

A drive shaft 80 is disposed between the drum 30 and the motor 40. The drive shaft 80 transmits rotary force of the motor 40 to the drum 30. One end of the drive shaft 80 is connected to the drum 30 and the other end of the drive shaft 80 is extended to the outside of a rear wall 21 of the tub 20.

A bearing housing 82 to rotatably support the drive shaft 80 is installed on the rear wall 21 of the tub 20. The bearing housing 82 is made of an aluminum alloy, and is inserted into the rear wall 21 of the tub 20 while the tub 20 is formed by injection molding. Bearings 84 allowing the drive shaft 80 to be smoothly rotated are installed between the bearing housing 82 and the drive shaft 80.

Figure 2:
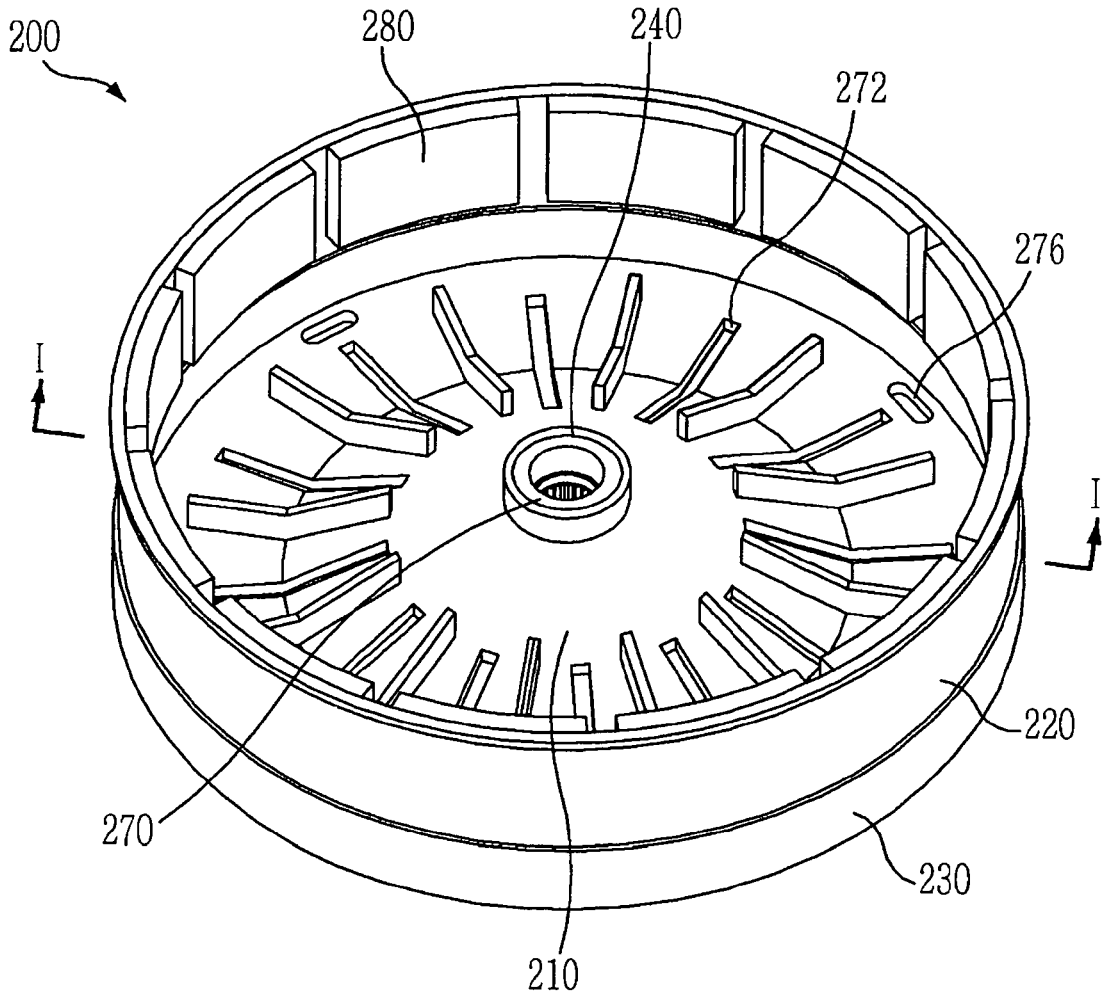
FIG. 2 is a perspective view illustrating a configuration of a rotor in accordance with the embodiment.
Figure 3:
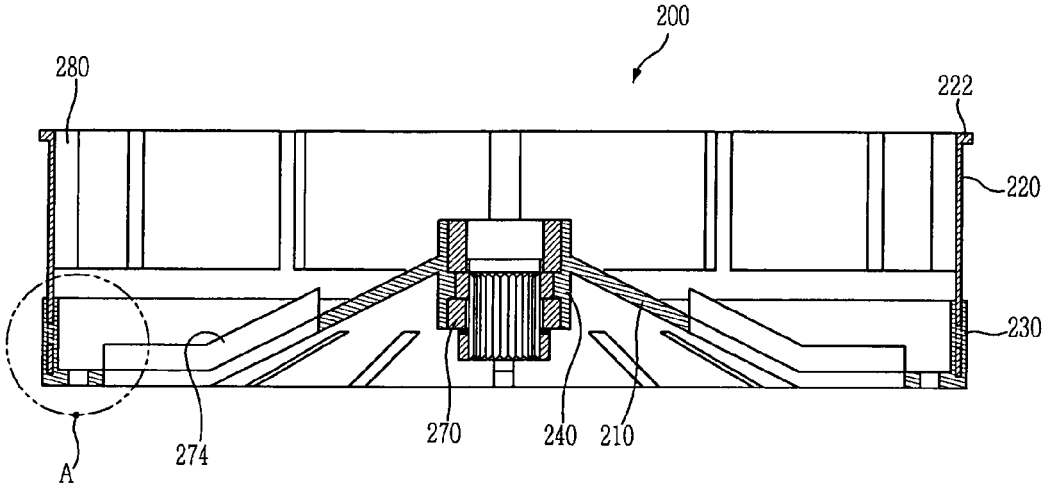
FIG. 3 is a cross-sectional view taken along the line of FIG. 2.
Figure 4:
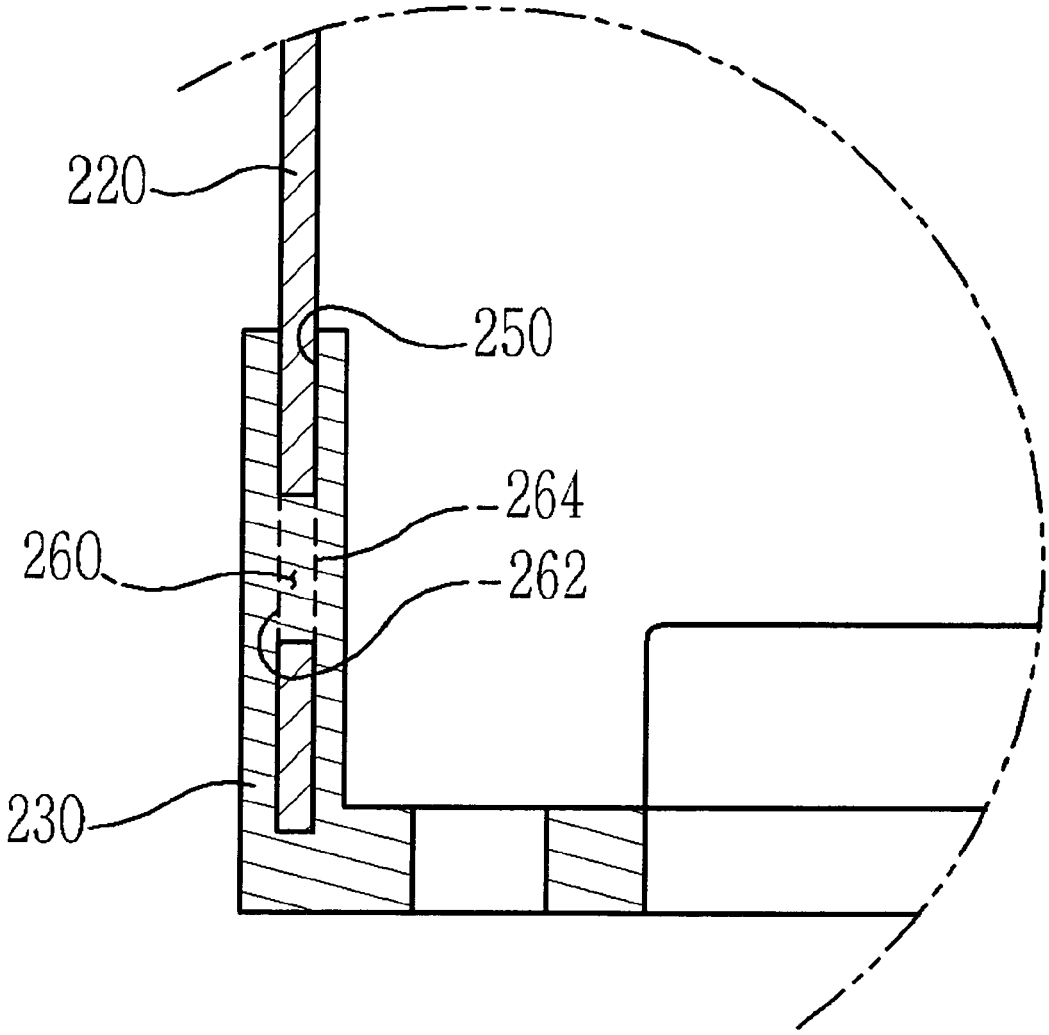
FIG. 4 is an enlarged view of the portion 'A' of FIG. 3.

FIG. 2 is a perspective view illustrating a configuration of a rotor in accordance with the embodiment, FIG. 3 is a cross-sectional view taken along the line I-I of FIG. 2, and FIG. 4 is an enlarged view of the portion 'A' of FIG. 3.

As shown in FIGS. 1 to 4, the motor 40 is disposed at the outside of the tub 20 and supplies power to the drum 30 to rotate the drum 30 in both directions. The motor 40 includes a stator 100 mounted on the rear wall 21 of the tub 20 and a rotor 200 disposed around the stator 100 and electromagnetically interacting with the stator 100.

The rotor 200 includes a bottom 210 and a side wall 220 connected to the bottom 210.

The bottom 210 is provided with a ring-shaped rib 230 formed at the edge of the bottom 210 to connect the side wall 220 to the bottom 210 and a central part 240 to which the drive shaft 80 is connected.

The ring-shaped rib 230 is protruded from the edge of the bottom 210 to a designated height in the circumferential direction of the bottom 210, and a connection groove 250 to which one end of the side wall 220 is connected is formed on the upper portion of the ring-shaped rib 230.

The connection groove 250 is formed on the upper portion of the ring-shaped rib 230 to a designated depth in the circumferential direction of the ring-shaped rib 230, and at least one connection protrusion 260, which is protruded from one surface 262 within the connection groove 250 toward the center of the bottom 210 and is connected to the other surface 264 within the connection groove 250, is provided within the connection groove 250. Further, the connection protrusion 260 may be arranged in the circumferential direction of the ring-shaped rib 230.

The central part 240 is protruded to the inside of the rotor 200, and a serration member 270 is connected to the inner surface of the central part 240. The serration member 270 is made of metal, such as iron or an aluminum alloy, and is connected to the end of the drive shaft 80 extended to the outside of the tub 20. The serration member 270 may be inserted into the central part 240 while the bottom 210 is formed by injection molding.

The height of the central part 240 may be greater than the height of the ring-shaped rib 230 formed at the edge of the bottom 210.

Further, a plurality of air inflow holes 272 and a plurality of cooling blades 274 are provided on the bottom 210.

The plurality of air inflow holes 272 serve to allow external air to flow into the rotor 200 when the rotor 200 is rotated, is formed through the bottom 210 in the radial direction of the bottom 210, and is arranged in the circumferential direction of the bottom 210.

The plurality of cooling blades 274 serve to generate an air flow within the bottom 210 to cool internal parts of the motor 40 when the rotor 200 is rotated, and are protruded to the inside of the rotor 200.

The plurality of cooling blades 274 is protruded to a designated height from the bottom 210 and is extended in the radial direction of the bottom 210, thus also serving to reinforce the strength of the bottom 210. Therefore, although the bottom 210 is thin, the plurality of cooling blades 274 prevents deformation of the bottom 210.

Holes 276 are arranged around the ring-shaped 230 in the circumferential direction. A worker assembling the motor 40 with the tub 20 easily observes whether or not a proper interval between the stator 100 and magnets 280 is uniformly maintained through the holes 276 formed around the ring-shaped rib 230.

Since all of the ring-shaped rib 230, the central part 240, the plurality of air inflow holes 272, the plurality of cooing blades 274 and the holes 276 are formed on the bottom 210, as described above, the bottom 210 functions as a base of the rotor 200.

Further, the ring-shaped rib 230, the central part 240, the plurality of air inflow holes 272, the plurality of cooing blades 274 and the holes 276, which are formed on the bottom 210, are formed integrally with the bottom 210 by injection molding.

Here, as a material used during injection molding, any plastic, such as fiberglass reinforced polypropylene (FRPP), having sufficient strength to prevent shape deformation thereof during rotation of the rotor 200 connected to the drive shaft 80 may be used.

As described above, the bottom 210 is formed by injection molding using plastic, and thus noise is reduced when the rotor 220 is rotated. If the bottom 210 is made of plastic, the bottom 210 generates lower noise as compared with a bottom made of metal, and functions as a kind of damper to reduce noise generated from surroundings.

Figure 5:
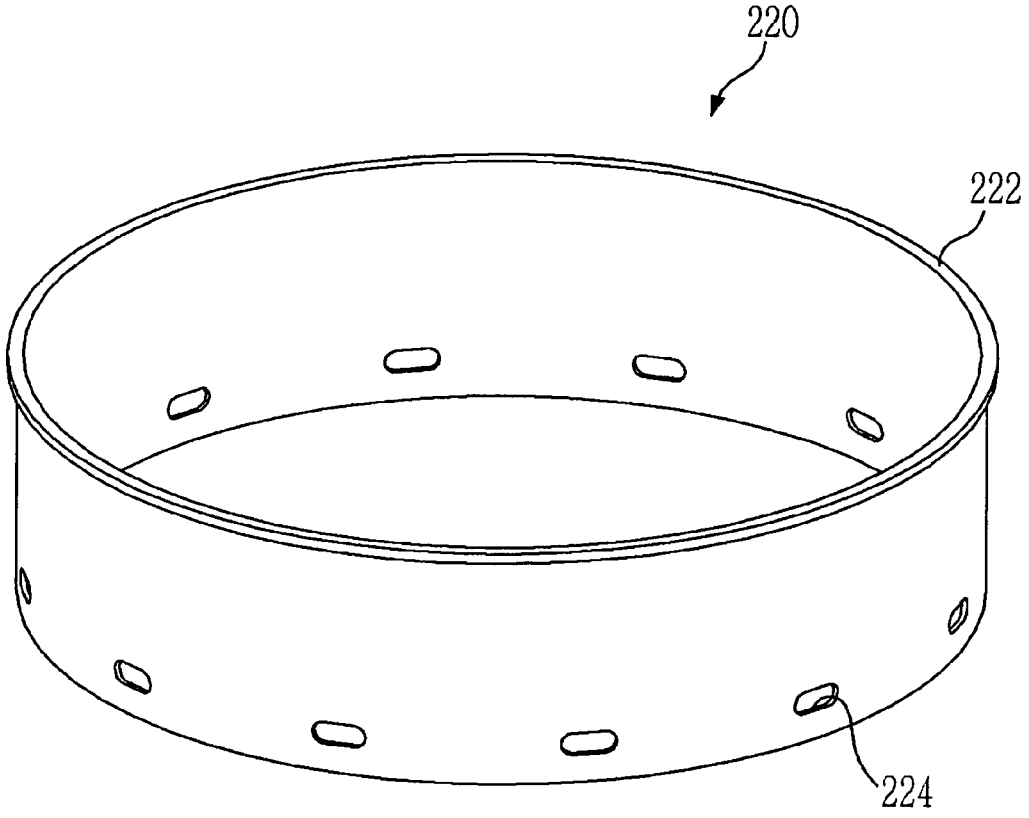
FIG. 5 is a perspective view of a side wall separated from FIG. 2.
Figure 6:
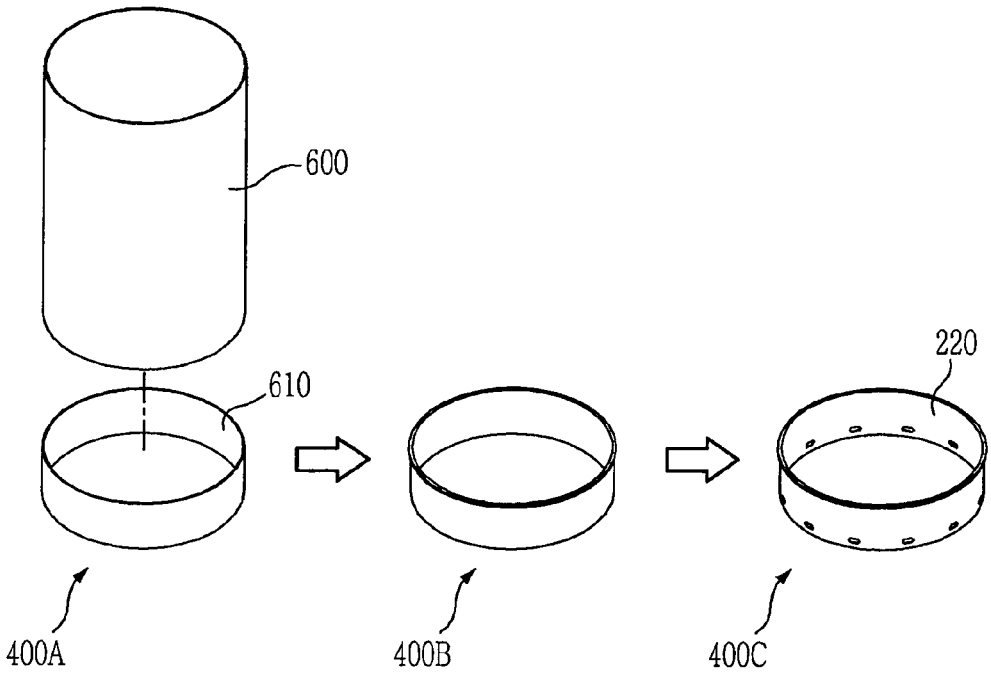
FIG. 6 is a view illustrating a process of manufacturing the side wall in accordance with the embodiment, shown in FIG. 5.

FIG. 5 is a perspective view of the side wall separated from FIG. 2 and FIG. 6 is a view illustrating a process of manufacturing the side wall in accordance with the embodiment of the present invention, shown in FIG. 5.

As shown in FIGS. 1 to 6, the side wall 220 is connected to the upper portion of the ring-shaped rib 230 of the bottom 210 in a direction of protruding and extending the ring-shaped rib 230. That is, the side wall 230 is connected to the ring-shaped rib 230 in parallel with the ring-shaped rib 230 such that the side wall 230 is vertical with respect to the bottom 210.

Further, the side wall 220 and the ring-shaped rib 230 are connected to each other, thereby completing the side surface of the bottom 210. Therefore, the ring-shaped rib 230 may be regarded as a first side wall and the side wall 220 may be regarded as a second side wall.

The side wall 220 is made of metal having magnetic properties. The side wall 220 generally has a thickness of more than 1.6 mm, but may have a thickness of less than 1.6 mm in order to achieve productivity improvement and material cost reduction.

A bending part 222 and through holes 224 are provided on the side wall 220.

The bending part 222 is formed by bending the upper end of the side wall 220 in a direction of extending the radius of the side wall 220.

The through holes 224 are formed through the lower end of the side wall 220 and are arranged in the circumferential direction of the side wall 220.

The side wall 220 is connected to a mold (not shown) for injection molding and is thus inserted into the ring-shaped rib 230 of the bottom 210 while the bottom 210 is formed by injection molding.

In more detail, the lower end of the side wall 220 is inserted into the ring-shaped rib 230 of the bottom 210. By inserting the lower end of the side wall 220 into the ring-shaped rib 230 of the bottom 210, the connection groove 250 is formed on the ring-shaped rib 230. That is, while molten resin injected into the mold fills a cavity (not shown) formed in the mold along the side wall 220, the molten resin located around the lower end of the side wall 220 forms the ring-shaped rib 230 and the connection groove 250.

Here, during the injection molding process of the bottom 210, the through holes 224 allow the molten resin to pass through the side wall 220 and the molten resin located in the through holes 224 is solidified to form the connection protrusions 260.

Since the bottom 210 and the side wall 220 are connected to each other by the connection protrusions 260 and the through holes 224, as described above, idle rotation of the side wall 220 in the connection groove 250 provided on the ring-shaped rib 230 and separation of the side wall 220 from the connection groove 250 when the rotor 200 is rotated is prevented.

Further, the magnets 280 are arranged on the inner surface of the side wall 220 in the circumferential direction. The magnets 280 are positioned opposite the stator 100 at a designated interval so as to electromagnetically interact with the stator 100.

The side wall 220 is made of metal having magnetic properties, as described above, and thus allows a magnetic field of the magnets 280 arranged on the inner surface of the side wall 220 to be uniformly distributed along the side wall 220 and prevents the magnetic field of the magnets 280 from leaking, thereby functioning as a back yoke ring connected to a rotor of a motor of a general washing machine as well as forming the side surface of the rotor 200.

The above side wall 220 is manufactured by a process, as follows.

As shown in FIG. 6, a circular basic material 610 is formed by cutting a cylindrical pipe 600 having a diameter equal or similar to the diameter of the bottom 210 of the rotor 200 to a designated height (Operation 400A). Here, in order to manufacture the pipe 600 to form the circular basic material 610, a general extrusion method or a method using a standard product having a diameter equal or similar to the diameter of the bottom 210 of the rotor 200 may be used. Further, the pipe 600 may be made of metal having magnetic properties.

After the circular basic material 610 is formed by cutting the cylindrical pipe 600, the bending part 222 is formed on the upper end of the circular basic material 610 (Operation 400B).

As described above, the bending part 222 means a part obtained by bending the circular basic material 610 in a direction of extending the radius of the circular basic material 610. The bending part 222 is formed by disposing the circular basic material 610 on a press device in which a mold having a shape corresponding to the shape of the being part 222 is mounted and by pressing the circular basic material 610 using a pressure unit of the press device.

After the bending part 222 is formed on the upper end of the circular basic material 610, the through holes 224 are formed on the side surface of the lower end of the circular basic material 610 (Operation 400C). Thereby, the side wall 220 is completed.

The through holes 224 are formed by disposing the circular basic material 610 on a press device provided with a jig having a shape corresponding to the shape of the through holes 224 and by pressing the circular basic material 610 using a pressure unit of the press device. Since the through holes 224 need to be arranged at designated intervals along the circumferential surface of the circular basic material 610, the jig having the shape corresponding to the shape of the through holes 224 is mounted on the press device such that the jig may be rotated around the circular basic material 610.

In the above process of manufacturing the side wall 220, the through holes 224 may be formed in advance. That is, the side wall 220 may be manufactured by forming through holes 224 on the side surface of the pipe 600 before cutting the pipe 600, cutting the pipe 600, and then forming the bending part 222.

Figure 7:
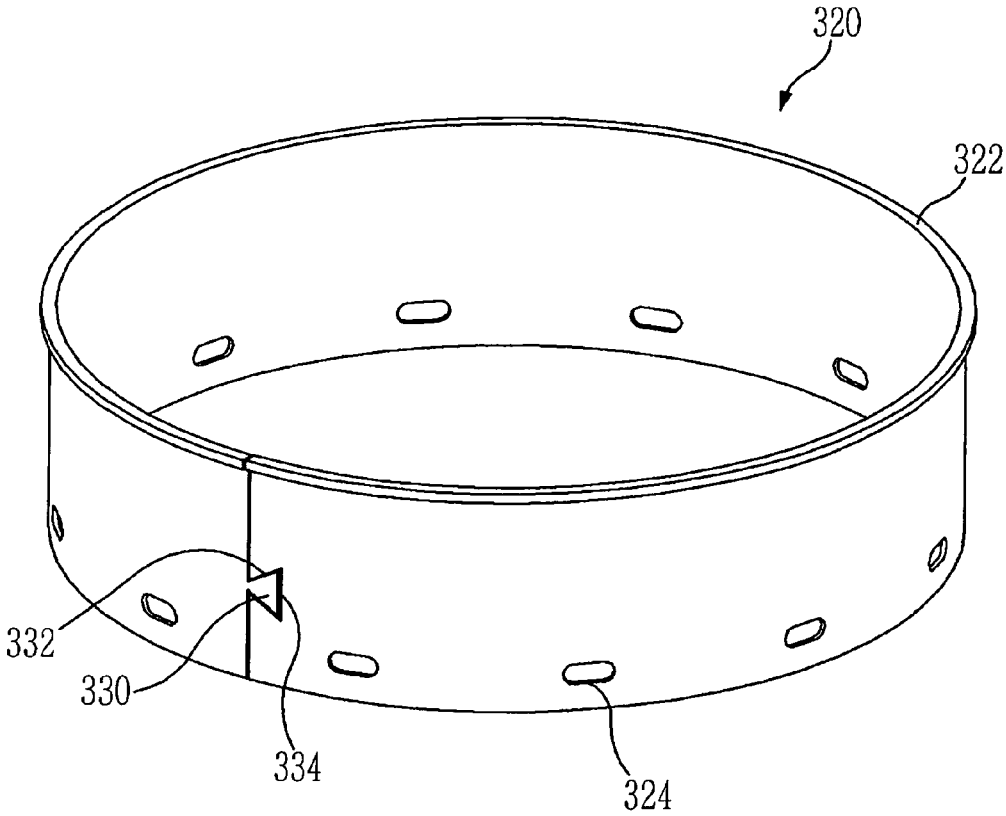
FIG. 7 is a perspective view of a side wall in accordance with another embodiment.
Figure 8:
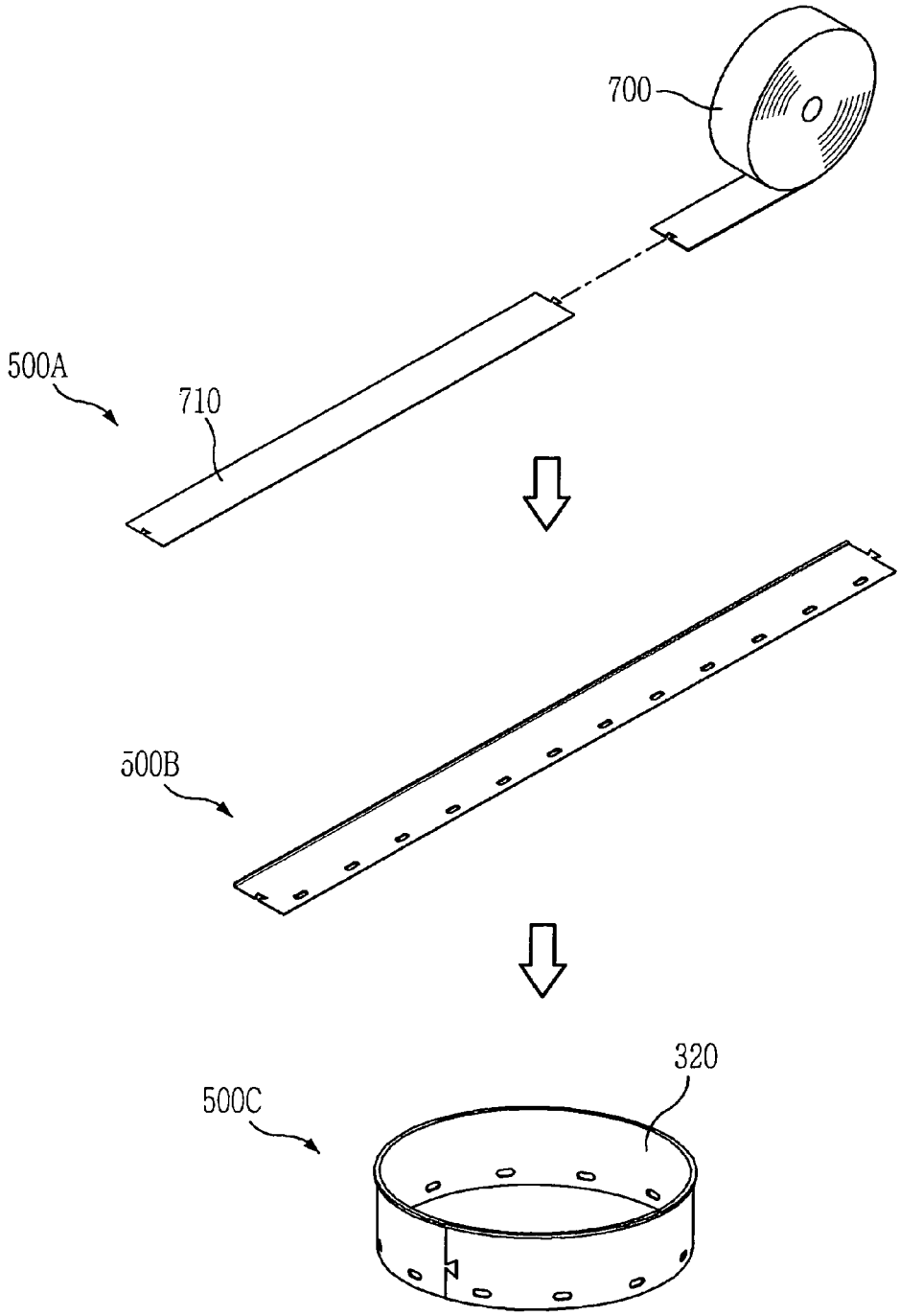
FIG. 8 is a view illustrating a process of manufacturing the side wall in accordance with the embodiment of the present invention, shown in FIG. 7.

FIG. 7 is a perspective view of a side wall in accordance with another embodiment and FIG. 8 is a view illustrating a process of manufacturing the side wall in accordance with the embodiment of the present invention, shown in FIG. 7.

As shown in FIGS. 7 and 8, a side wall 320 of a rotor 200 may be manufactured in a method differing from the former method of manufacturing the side wall 220 by cutting the cylindrical pipe 600.

First, a unit basic material 710 is formed by cutting a roll basic material 700 having a width corresponding to the height of the rotor 200 to a designated length (Operation 500A). Here, the roll basic material 700 may be made of metal having magnetic properties.

After the unit basic material 710 is made, a bending part 322 and through holes 324 are formed on the unit basic material 710 (Operation 500B).

Differing from the former method of manufacturing the side wall 220 by cutting the cylindrical pipe 600, the unit basic material 710 has a flat shape other than a cylindrical shape, and thus if the through holes 324 are formed, it is not necessary to mount a jig on a press device such that the jig is rotatable or to use a rotatable jig, but the through holes 324 are formed by transferring the unit basic material 710 at a regular velocity to a press device on which a jig having a shape corresponding to the shape of the through holes 324 is mounted.

Further, without transfer of the unit basic material 710, the through holes 324 may be formed through one pressing process using jigs provided in the number of the through holes 324 formed on the unit basic material 710, which are integrally formed.

After the bending part 322 and the through holes 324 are formed on the unit basic material 710, the unit basic material 710 is rolled into a cylindrical shape and then both ends of the unit basic material 710 are fixed to each other (Operation 500C). Thereby, the side wall 320 is completed.

In order to fix both ends of the unit basic material 710 to each other, a fixing protrusion 330 is provided on one end of the unit basic material 710 and a fixing depression 334 is provided on the other end of the unit basic material 710. The fixing protrusion 330 has inclined planes 332 such that the cross-sectional area of the fixing protrusion 330 is gradually increased in the protruding direction of the fixing protrusion 330 and the fixing depression 334 has a shape corresponding to the fixing protrusion 330. Therefore, both ends of the unit basic material 710 are fixed to each other by press-fitting the fixing protrusion 330 into the fixing depression 334.

Here, the fixing protrusion 330 and the fixing depression 334 are formed during cutting of the roll basic material 700 into the unit basic material 710. The fixing protrusion 330 and the fixing depression 334 may be formed using a press device on which a pressure unit having a shape corresponding to the fixing protrusion 330 or the fixing depression 334 is mounted.

Both ends of the unit basic material 710 may be connected by other methods, such as welding.

If the side wall 220 or 320 is manufactured by cutting the cylindrical pipe 600 or by rolling the unit basic material 710, the side wall 220 or 320 may be manufactured separately and then inserted into the mold, as described above. Therefore, when the rotor 200 is manufactured, a large-sized mold to form the side wall 220 and 320 integrally with the rotor 200 is not required and thus a complex process to manufacture the large-sized mold is not required.

As is apparent from the above description, in a motor for a washing machine and a washing machine having the same in accordance with each of embodiments of the present invention, a manufacturing process of a rotor of the motor is shortened and thus productivity is improved.

Further, noise generated when the rotor of the motor is rotated is reduced and user convenience is improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A motor for a washing machine, which comprises a rotor to rotate a drum of the washing machine, the rotor comprising:

a base;

a ring-shaped rib formed at the edge of the base; and a back yoke ring connected to the ring-shaped rib, wherein the back yoke ring is inserted into the ring-shaped rib while the base is formed by injection molding, a connection groove connected with one end of the back yoke ring is provided on the upper portion of the ring-shaped rib, at least one connection protrusion formed in the circumferential direction of the base is provided at the inside of the connection groove, and at least one connection hole connected with the at least one connection protrusion is provided on the side surface of the back yoke ring in the circumferential direction of the back yoke ring.

2. The motor according to claim 1, wherein the ring-shaped rib and the back yoke ring are made of different materials and the back yoke ring is connected to the upper portion of the ring-shaped rib in a direction of extending the ring-shaped rib.

3. The motor according to claim 1, wherein magnets are connected to the inner surface of the back yoke ring in the circumferential direction of the back yoke ring.

4. The motor according to claim 1, wherein the base includes air inflow holes formed through the base in the radial direction.

5. The motor according to claim 1, wherein the base includes cooling blades protruded to the inside of the rotor.

6. A motor for a washing machine, which comprises a rotor connected with a drive shaft, the rotor comprising:

a bottom formed by injection molding using plastic;

a ring-shaped rib formed at the edge of the bottom;

a side wall made of metal having magnetic properties and connected to the ring-shaped rib;

magnets connected to the inner surface of the side wall in the circumferential direction of the side wall;

a connection groove formed on the upper portion of the ring-shaped rib, the connection groove extending the entire circumference of the ring-shaped rib; and at least one connection protrusion provided at the inside of the connection groove, the at least one connection protrusion being formed in the circumferential direction of the bottom, wherein the side wall is inserted into the connection groove of the ring-shaped rib while the bottom is formed by injection molding.

7. The motor according to claim 6, wherein the side wall is connected to the upper portion of the ring-shaped rib in a direction of extending the ring-shaped rib.

8. The motor according to claim 6, wherein the side wall includes:

a bending part bent in a direction of extending the radius of the side wall; and at least one through hole.

9. The motor according to claim 6, wherein the bottom includes:

air inflow holes formed through the bottom in the radial direction so that external air is introduced into the rotor through the air inflow holes; and cooling blades protruded to the inside of the rotor so as to generate an air flow within the rotor.

10. The motor according to claim 6, wherein a central part of the bottom is protruded to the inside of the rotor.

* * * * *